US007058323B2

(12) United States Patent
Maeyama et al.

(10) Patent No.: US 7,058,323 B2
(45) Date of Patent: Jun. 6, 2006

(54) IMAGE FORMING APPARATUS

(75) Inventors: Ryuichiro Maeyama, Ebina (JP); Kenichi Kobayashi, Ebina (JP); Tomoshi Hara, Minamiashigara (JP); Kazuyuki Tsukamoto, Kanagawa (JP); Koji Morofuji, Ebina (JP); Tsutomu Udaka, Ebina (JP); Shinichi Tai, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/060,814

(22) Filed: Feb. 18, 2005

(65) Prior Publication Data

US 2005/0286918 A1 Dec. 29, 2005

(30) Foreign Application Priority Data

Jun. 23, 2004 (JP) ..... 2004-184885

(51) Int. Cl.
*G03G 15/00* (2006.01)

(52) U.S. Cl. ..... 399/45; 399/9; 399/14; 399/15

(58) Field of Classification Search ..... 399/45
See application file for complete search history.

(56) References Cited

U.S. PATENT DOCUMENTS 5,488,458 A * 1/1996 Benedict et al. ..... 399/15
2003/0175602 A1* 9/2003 Kazama ..... 399/9
2005/0084275 A1* 4/2005 Maeyama et al. ..... 399/45
2006/0001691 A1* 1/2006 Maeyama et al. ..... 347/19

FOREIGN PATENT DOCUMENTS

JP 2000-259044 9/2000

* cited by examiner

*Primary Examiner*—Arthur T. Grimley
*Assistant Examiner*—Ryan D. Walsh
(74) *Attorney, Agent, or Firm*—Morgan, Lewis, Bockius, LLP

(57) ABSTRACT

An image forming apparatus with an image forming part and a fixing part for fixing images on a recording medium measures, downstream of the fixing part in a transport path, speckles on a recording medium, and generates measured speckle data representing the measured speckles; stores measured speckle data with standard speckle data representing speckles on a recording medium that has not undergone a fixing process; further measures, upstream of the image forming part, measures speckles on a recording medium; and when the stored standard speckle data is the most analogous to speckles measured for the second time, applies corrections in order to compensate for the lengthening of the recording medium by a fixing process to document images formed thereon, and when the stored measured speckle data is the most analogous to speckles measured for the second time, does not perform the corrections in order to compensate for the lengthening.

2 Claims, 11 Drawing Sheets

IMAGE FORMING APPARATUS

BACKGROUND OF THE INVENTION

1. Field of the Invention

This invention concerns technology for correcting images to be transferred to paper.

2. Description of the Related Art

In an image forming apparatus that allows transferring/fixing of paper formed by electronic photography systems, images that have been formed on a photoreceptor medium are corrected, transferred and fixed to appropriate locations on a paper that is the recording medium being used (see, for example, Japanese Patent Application Laid-Open Publication No. 2000-259044, hereinafter, JP 2000-259044).

The image forming apparatus disclosed in JP 2000-259044 is capable of correcting an image that will be transferred/fixed based on the state of the paper, and of transferring and fixing the image in an appropriate location of the paper, thereby enabling formation of the image with high precision on the paper.

When performing image formation, the unused paper has moisture which evaporates because of the heat and added pressure when the image is being fixed, giving rise to lengthening. As well, for an inkjet-based image forming apparatus, swelling of paper occurs because of absorption of ink in the spaces between the fibers of the paper (capillarity) when the ink is absorbed into the paper, and it has been reported that this gives rise to lengthening of the paper, in the same way as occurs in paper after fixing. For this reason, when forming an image, correction of the image and forming of the image taking into account this lengthening, is performed. On the other hand, for paper that has become used by having images formed on only one side, because it has already been lengthened once, it is desirable to correct the images by taking into account this lengthening. In JP 2000-259044, there is disclosed a technique for correcting an image and recording on the paper the corrected image; but it does not disclose a design that performs correction of images on the reverse side by taking into account paper that has already been lengthened. For this reason, using the image forming apparatus disclosed in JP 2000-259044, it is impossible to form a highly precise image on a reverse side of a paper.

As well, there is a long grain and a short grain in the paper, depending on the direction of the fibers. For an image forming apparatus, because the amount of lengthening of the paper differs depending on a direction of the paper grain when the paper passes through a fixing roller that performs a fixing process, it is desirable to perform a correction taking into account this lengthening at the time of recording the image on the paper.

However, with the image forming apparatus disclosed in JP 2000-259044, there is no disclosure of a design for performing correction of images taking paper grain into account. For this reason, with the image forming apparatus disclosed in JP 2000-259044, it is impossible to form images with good precision that take paper grain into account.

SUMMARY OF THE INVENTION

The present invention has been made in view of the above-mentioned background, and provides a technique for correcting images transferred/fixed on paper corresponding to attributes of the recording medium on which the image is to be recorded.

In one aspect, the present invention provides an image forming apparatus provided with an image forming part for forming document images on a recording medium, and a fixing part for fixing the images formed on the recording medium to the recording medium, wherein the apparatus comprising: a first measuring part which is downstream of the fixing part in a transport path for the recording medium, measures speckles in the recording medium transported, and generates a measured speckle data representing the measured speckles; a memory part for storing the measured speckle data generated by the first measuring part with a standard speckle data representing speckles on the recording medium that has not undergone the fixing part; a second measuring part which is upstream of the image forming part in a transport path for the recording medium and measures speckles on the recording medium transported; and a correction part which applies corrections to the document images formed on the recording medium in order to compensate for the lengthening of the recording medium formed by the fixing part, in a case where, among the speckle data stored in the memory part, the standard speckle data is the most analogous to the speckles measured by the second speckle measuring part; and, does not apply corrections to the document images formed on the recording medium in order to compensate for the lengthening of the recording medium formed by the fixing part in a case where, among the speckle data stored in the memory part, the measured speckle data is the most analogous to the speckles measured by the second measuring part.

The image forming apparatus allows the formation of images on a recording medium, and the fixing of images formed on a recording medium. The image forming apparatus, after the image has been fixed on the recording medium, measures the speckles of the recording medium and records the data representing the speckles measured. As well, the image forming apparatus measures the speckles after forming the image on the recording medium, and in a case where it stores data that represents speckles analogous to the measured speckles, it recognizes that the recording medium is one that does not require applying corrections to compensate for the lengthening of the recording medium caused by fixing processes, i.e., that it is the reverse side of the paper. When the image forming apparatus recognizes that the recording medium is one that does not require correction, it forms the document image without applying to the image corrections to compensate for the lengthening of the recording medium caused by the fixing operation.

In another aspect, the present invention provides an image forming apparatus provided with an image forming part for forming document images on a recording medium, and a fixing part for fixing the images formed on the recording medium to the recording medium, wherein the apparatus comprising: a memory part for storing a long grain speckle data representing speckles of the recording medium on the direction of a long grain and a short grain speckle data representing speckles of the recording medium on the direction of a short grain; a first measuring part which is upstream of the image forming part in a transport path for the recording medium and measures speckles on the recording medium transported; and a correction part which applies corrections to the document images formed on the recording medium in order to compensate for the lengthening of the recording medium that is fixed on the direction of the long grain, in a case where, among the speckle data stored in the memory part, the long grain speckle data is the most analogous to the speckles measured by the first measuring part; and applies corrections to the document images formed on the recording medium in order to compensate for the lengthening of the recording medium that is fixed on the direction of the short grain in a case where, among the speckle data stored in the memory part, the short grain speckle data is the most analogous to the speckles measured by the first measuring part.

The image forming apparatus forms the image on the recording medium, and sets the image formed on the recording medium. The image forming apparatus measures the speckles before forming the image on the recording medium. The image forming apparatus measures the speckles before forming the image on the recording medium and, in a case where, among stored speckle data, long grain speckle data is the most analogous to the measured speckles data, it applies the correction to document images formed on the recording medium in order to compensate for the lengthening of the recording medium that is fixed on the direction of the long grain, and in a case where, among stored speckle data, the short grain speckle data is the most analogous to speckles measured by the first measuring part, applies corrections to document images formed on the recording medium in order to compensate for the lengthening of the recording medium that is fixed on the direction of the short grain.

According to an embodiment of the invention, it is possible to correct an image transferred/fixed on paper, corresponding to the attributes of a recording medium that records the image.

BRIEF DESCRIPTION OF THE DRAWINGS

Embodiments of the present invention will be described in detail based on the following figures, wherein.

DETAILED DESCRIPTION OF THE INVENTION

Below, description will be given of an embodiment that implements the present invention.

[A. Composition of the Embodiment]

Figure 1:
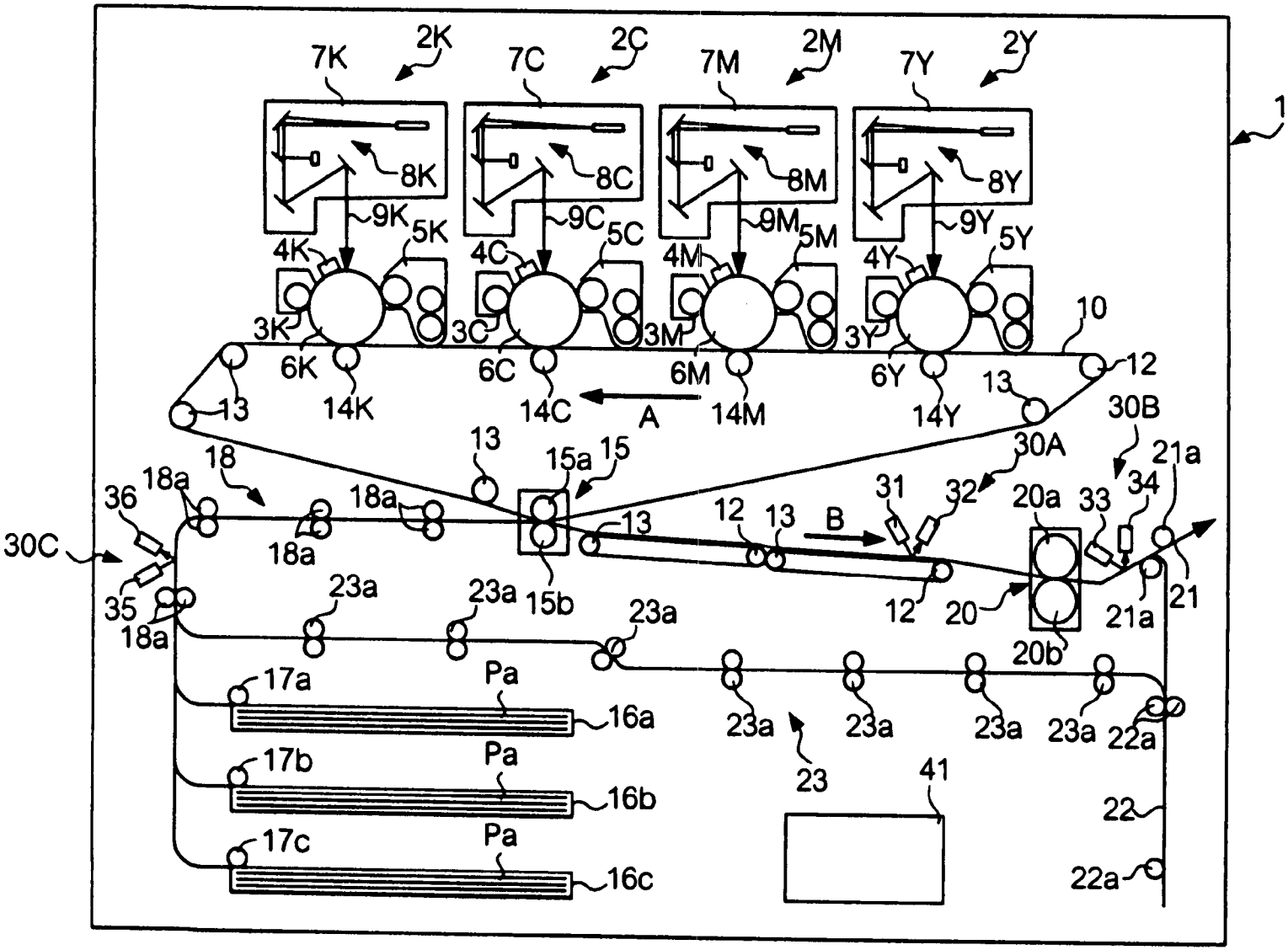
FIG. 1 shows an entire composition of an image forming apparatus 1 according to the present invention.

FIG. 1 shows an entire configuration of image forming apparatus 1 according to an embodiment of the present invention. Image forming apparatus 1 is, for example, a color printer or a color copier, or a multi-functional unit that combines these functions.

Image forming stations 2Y, 2M, 2C, and 2K form images using respective toners Yellow (Y), Magenta (M), Cyan (C), and Black (K), and transfer on the surface of a transfer belt 1 the images formed. The composition of the image forming stations is described below, but the composition of each image forming station is the same except for the difference in corresponding toner colors. For this reason, the descriptions of the image forming station 2Y for Yellow (Y) are provided, but explanation of the image forming stations 2M, 2C, and 2K for Magenta, Cyan, and Black, respectively, is omitted.

Image forming station 2Y is provided with a cleaner 3Y, a charging unit 4Y, a developer unit 5Y, a photoreceptor drum 6Y, and an exposure unit 7Y. On the outer circumferential face (drum surface) of photoreceptor drum 6Y, a photosensitive layer is formed, and photoreceptor drum 6Y is rotated by a driver mechanism (not shown). Charging unit 4Y is a charging apparatus that may be, for example, a roller-type charging apparatus, or a corotron-type charging apparatus, and it evenly charges the surface of photoreceptor drum 6Y to a prescribed voltage. Exposure unit 7Y is provided with a laser scanning unit 8Y that scans a laser beam. Exposure unit 7Y scans a laser beam modulated in response to document data with laser scanning unit 8Y, and by exposing the photoreceptor drum 6Y that has been evenly charged to the laser beam, forms an electrostatic latent image on the surface of photoreceptor drum 6Y. Developer unit 5Y is provided with a storage container that stores yellow toner (not shown), and is disposed in a location adjoining photoreceptor drum 6Y. Then, the toner stored in the storage container is electrically transferred to the electrostatic latent image formed on photoreceptor drum 6Y. In this manner, a toner image is formed on the surface of photoreceptor drum 6Y. A transferring unit 14Y is disposed in a location opposite the photoreceptor drum 6Y with respect to transfer belt 10. Transferring unit 14Y transfers a toner image formed on photoreceptor drum 6Y onto the outer circumferential surface of transfer belt 10 held between photoreceptor drum 6Y and transferring unit 14Y. Transfer belt is an endless loop belt, and its inner circumferential surface is tensioned by several follower rollers 13 and a drive roller 12 that is rotated by a motor (not shown). When transfer belt 10 is rotationally driven by these rollers in the "A" direction marked in the figure, the toner image transferred on transfer belt 10 by image forming stations 2Y, 2M, 2C and 2K, and transferring units 14Y, 14M, 14C and 14K, is transferred in the direction of a sheet transferring unit 15. Cleaner 3Y removes the toner left on the surface of photoreceptor drum 6Y after the toner image has been transferred onto transfer belt 10.

Paper cassettes 16*a*, 16*b*, and 16*c* are cassettes that store sheets Pa (such as unused paper, and reverse sides of used paper) that are the recording medium for recording images. The size of the sheets Pa stored in each cassette may respectively differ. Paper cassettes 16*a*, 16*b* and 16*c*, by means of a spring provided in the lower part of the cassette, presses the stored sheets Pa onto pickup rollers 17*a*, 17*b* and 17*c* provided in the upper part of the cassettes. Pickup rollers 17*a*, 17*b* and 17*c* transport sheets Pa in contact with the rollers from the cassettes to a transport path 18.

Transport path 18 has several transport rollers 18*a* at prescribed intervals. These transport rollers 18*a* transport the sheets Pa sent into transport path 18 toward sheet transferring unit 15.

Sheet transferring unit 15 is provided with transferring rollers 15*a* and 15*b* sandwiching transfer belt 10. Sheets Pa conveyed from transport path 18, while in contact with the outer circumferential surface of transfer belt 10 that is held between transferring rollers 15*a* and 15*b*, passes between these two rollers. In this manner, the toner image transferred on the outer circumferential surface of transfer belt 10 is transferred onto sheet Pa.

A conveying belt 19 is an endless loop belt, and its inner circumferential surface is tensioned by several follower rollers 13 and drive rollers 12. Conveying belt 19 is rotationally driven by these rollers in the "B" direction marked in the figure, and transports sheets Ps that have passed through sheet transferring unit 15 toward a fixing unit 20.

Fixing unit 20 is provided with a heat-fusing roller 20*a* and a pressing roller 20*b* opposite heat-fixing roller 20*a* with respect to the transport path. Heat-fusing roller 20*a* is provided with a heat source such as a halogen lamp in its interior, and heats the surface temperature of heat-fusing roller 20*a* to a prescribed temperature from inside the roll. Pressing roller 20*b* is pushed in the direction of heat-fixing roller 20*a* by a pressure spring (not shown) or the like. Fixing unit 20 fixes on sheet Pa the toner image transferred on it by rapidly heating it while adding pressure using heat-fixing roller 20*a* and pressing roller 20*b*.

Provided downstream from fixing unit 20 placed in the path on which sheet Pa is transported are a transport path 21 and a transport path 22. Image forming apparatus 1, in the case where there is an image recorded on only one side of sheet Pa, ejects sheet Pa that has passed through fixing unit 20 to the exterior of the image forming apparatus 1 using a transport roller 21*a*, and in the case of forming an image on both sides of sheet Pa, transports sheet Pa that has passed through fixing unit 20 to transport path 22. Transport roller 22*a* is disposed in transport path 22. A transport roller 22*a* moves sheet Pa that has been transported along transport path 22 to a transport path 23. Several transport rollers 23*a* are disposed in transport path 23. Transport rollers 23*a* move sheet Pa that has been transported along transport path 23 to transport path 18.

Disposed in the vicinity of the transport paths are speckle measuring units 30A, 30B and 30C for measuring the speckles of sheet Pa.

With speckles, there are high-contrast patterns of irregular speckle shapes revealed when exposing bodies to a coherent light such as a laser beam when the surface roughness is sufficiently large compared to the wavelength of this light.

Downstream of sheet transferring unit 15 along transport path 18, a speckle measuring unit 30C is disposed. Speckle measuring unit 30C is provided with a light source 35 and an optical sensor 36. Light source 35 projects a coherent light (for example, a laser beam) onto sheet Pa in transport path 18. Optical sensor 36 has a photoelectric sensing element, and receives diffused light reflected from the light source by sheet Pa. Then it outputs to control unit 41 a signal representing speckles formed by that diffused light.

Figure 2:
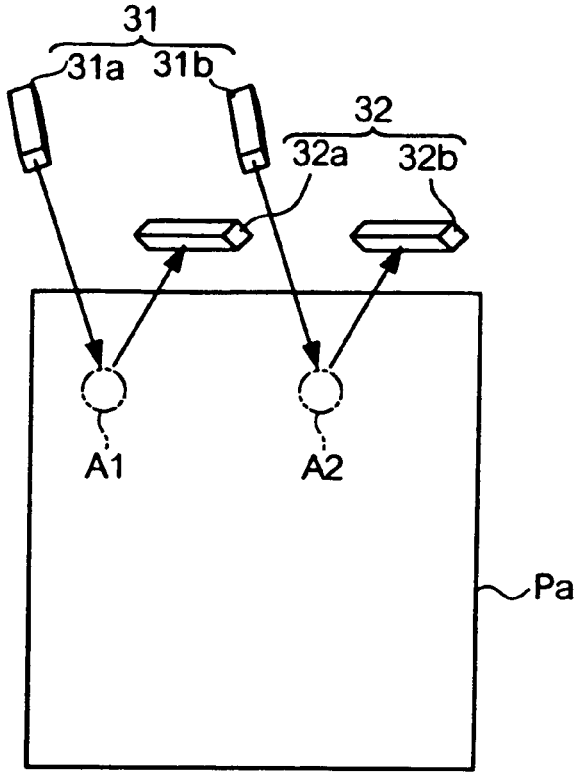
FIG. 2 shows in schematic form a speckle measuring part 30A.

Upstream of fixing unit 20 along conveying belt 19, speckle measuring unit 30A is disposed. Speckle measuring unit 30A has a light source and an optical sensor (not shown) for finding the location of an end of sheet Pa, and a light source 31 and an optical sensor 32 for measuring the speckles. FIG. 2 shows schematically light source 31 and optical sensor 32 that measure the speckles. As shown in FIG. 2, speckle measuring unit 30A is provided with light sources 31*a* and 31*b*, and optical sensors 32*a* and 32*b* corresponding to these respective light sources. Light source 31*a* and 31*b* have scanning parts (not shown), and project a coherent light (for example, a laser beam) onto sheet Pa on conveying belt 19. Optical sensors 32*a* and 32*b* have photoelectric sensing elements, and receive diffused light that has diffused from sheet Pa by reflection from light sources 31*a* and 31*b*. Then a signal representing the speckles formed by the diffused light is output to control unit 41.

Figure 3:
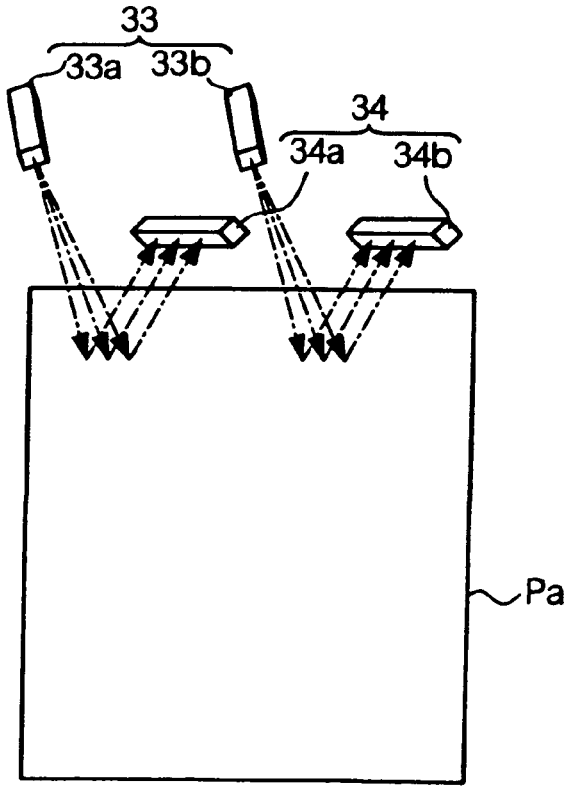
FIG. 3 shows in schematic form a speckle measuring part 30B.

Downstream of fixing unit 20 along the transport path, speckle measuring unit 30B is disposed. Speckle measuring unit 30B has a light source and an optical sensor (neither shown) for finding the location of an end of sheet Pa, and a light source 33 and an optical sensor 34 for measuring the speckles. FIG. 3 shows schematically light source 33 and optical sensor 34 for measuring the speckles. As shown in FIG. 3, speckle measuring unit 30B is provided with light sources 33*a* and 33*b*, and optical sensors 34*a* and 34*b* corresponding to these respective light sources. Light sources 33*a* and 33*b* have scanning parts (not shown), and project a coherent light (for example, laser beam) onto sheet Pa in transport path 21. Optical sensors 34*a* and 34*b* have photoelectric sensing elements, and receive diffused light that has diffused from sheet Pa by reflection from light sources 33*a* and 33*b*. Then a signal indicating the speckles formed by the diffused light is output to control unit 41.

Figure 4:
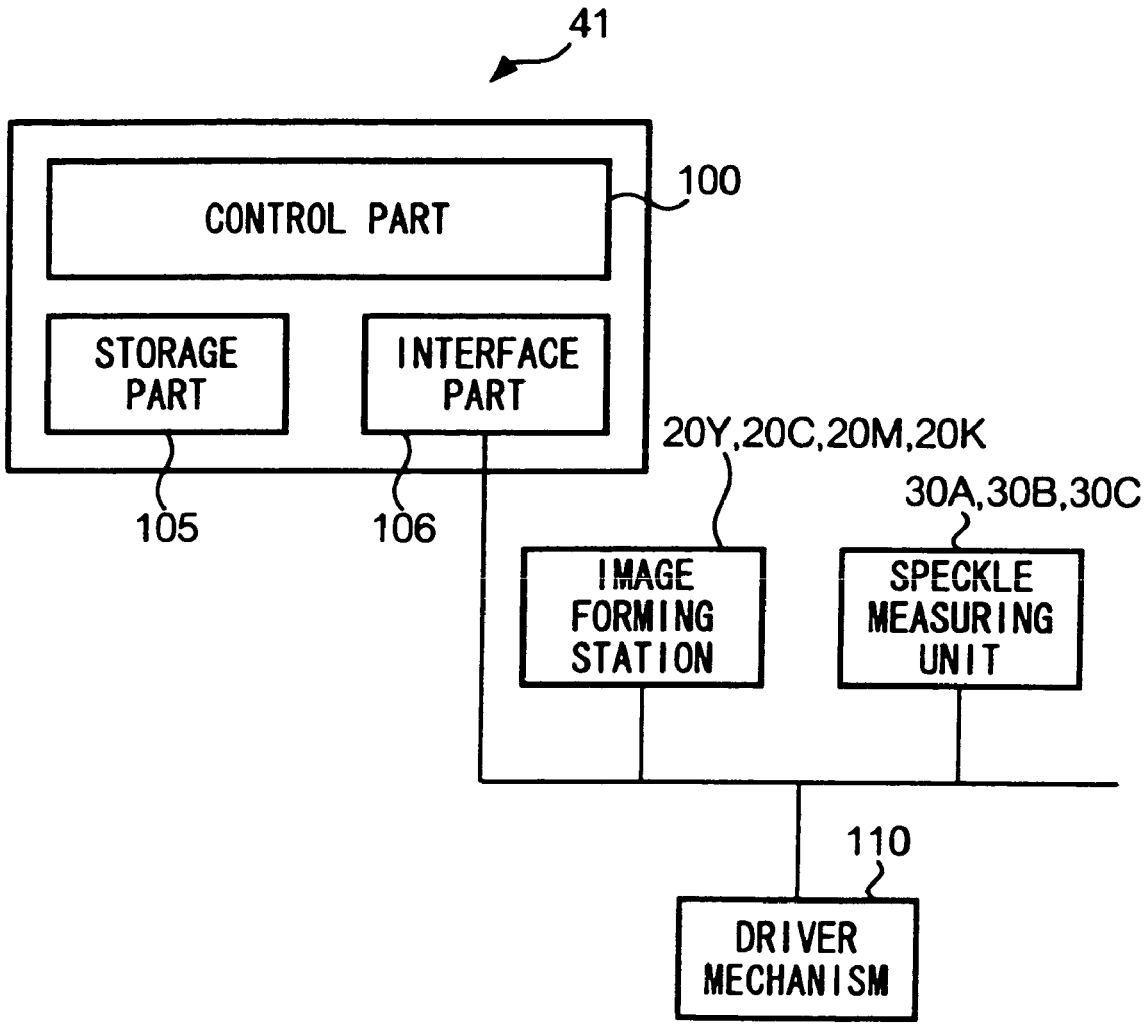
FIG. 4 is a block diagram showing the composition of a control unit 41.

Next, description will be given of the composition of control unit 41 that controls each part of image forming apparatus 1. FIG. 4 shows a hardware composition of control unit 41. As shown in FIG. 4, control unit 41 has a control part 100 with CPU (Central Processing Unit), ROM (Read Only Memory), RAM (Random Access Memory), a storage part 105 having nonvolatile memory, a driver mechanism 110 for rotating the drive rollers and transport rollers and the like, image forming stations 2Y, 2M, 2C, and 2K, and speckle measuring units 30A, 30B and 30C and the like, and an interface part 106 used for communication signals between each part of image forming apparatus 1. Storage part 105 stores standard speckle data representing speckles arising on unused sheets. As well, storage part 105 stores measured speckle data indicating speckles measured using speckle measuring unit 30C. In the ROM, a control program is stored, and when the power for image forming apparatus 1 is turned on, the CPU reads out and starts up the control program stored in the ROM. When the CPU starts the control program, control unit 41 becomes capable of controlling various operations and various parts, and of performing various functions of a multi-functional machine.

[B. Operations of the Embodiment]

Next, operations of the present embodiment are explained. In the explanation below, first, after describing the operations in the case of recording an image on only one side of an unused sheet, an example of operations in the case of using sheet Pa as a reverse side that already records an image is described, and then the operations in the case of forming an image on both sides of an unused sheet Pa are described.

[B-1. Example of Operations in the Case of Recording on Only One Side of Unused Sheet Pa]

For the explanation below, description will be given of the operations, assuming the case of recording an image on unused paper stored in paper cassette 16*a*.

Figure 5:
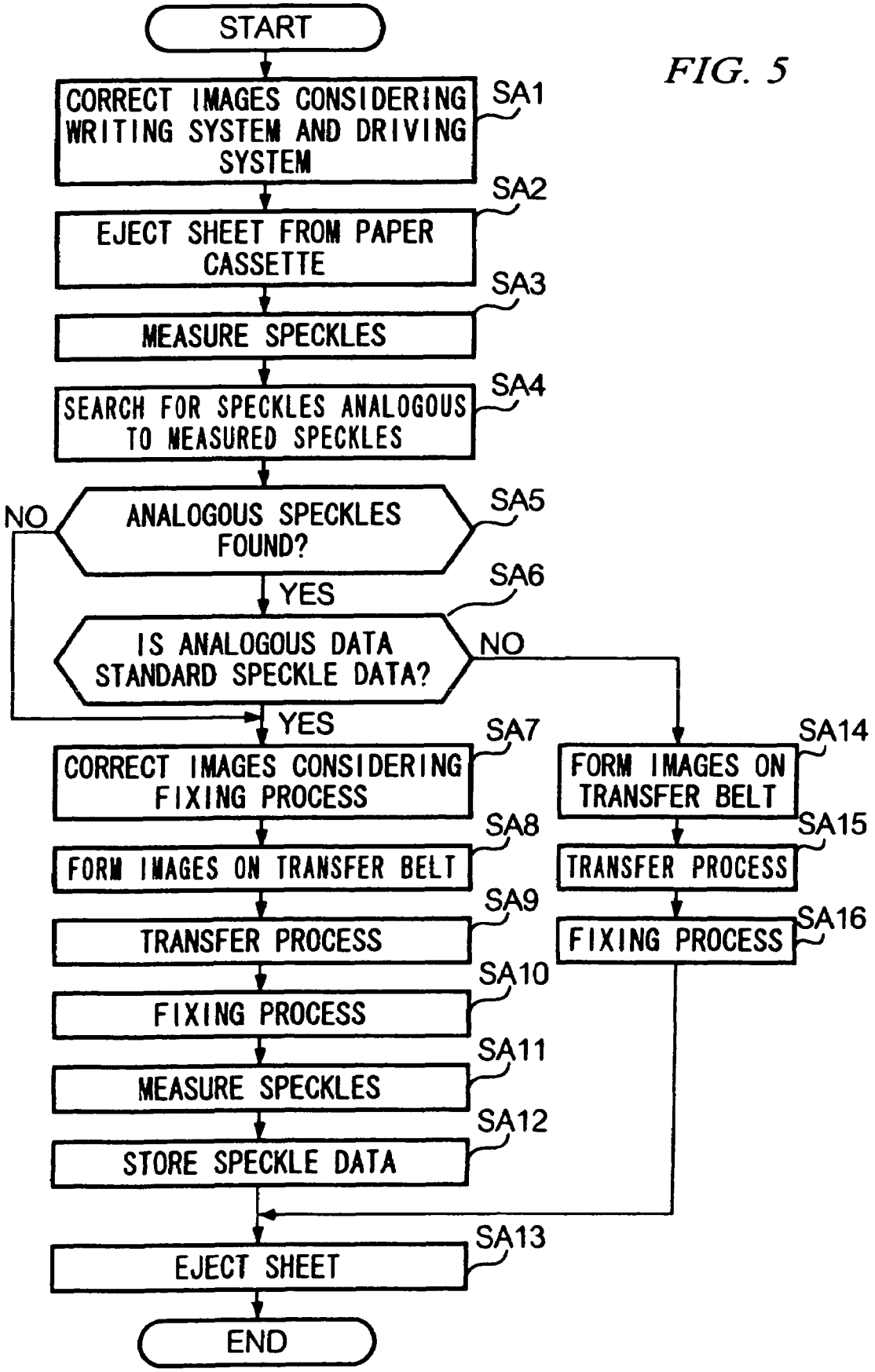
FIG. 5 is a flowchart showing the flow of operations when an image is formed on one side of a sheet.

First, after performing settings for the copying so as to record on only one side of sheet Pa, when the document is read, data representing the document read is stored in RAM. Control unit 41, when it stores the document data in RAM, compensates sub scanning misregistration, skew, displacement of a starting location of the main scanning, mismagnification for the main scanning, mismagnification for the sub scanning, and the like that have been caused by a writing system and a driving system such as laser scan units 8Y, 8M, 8C and 8K, transfer belt 10, and photoreceptor drum 6Y, 6M, 6C and 6K, thereby correcting the image representing the document data (FIG. 5: Step SA1). Because such corrections have been previously accomplished, explanation of the details will be omitted here.

Next, control unit 41 rotates pickup roller 17*a*, and the sheet Pa in contact with pickup roller 17*a* is moved into transport path 18 (Step SA2). Control unit 41, when it moves sheet Pa into transport path 18, controls speckle measuring unit 30C, and projects a laser beam from light source 35 onto sheet Pa (Step SA3). This laser beam gives rise to speckles diffusing from sheet Pa. The optical sensor 36 of speckle measuring unit 30C outputs to control unit 41 a signal SP1 that indicates these speckles.

Control unit 41 takes this signal SP1 and reads out standard speckle data stored in storage part 105 and the measured speckle data. Control unit 41 performs pattern matching between the speckles represented by signal SP1 and speckles represented by the speckle data read out, and searches for data representing speckles analogous to the speckles represented by signal SP1 (Step SA4). Control unit 41, in the case of where data representing speckles analogous to the speckles represented by signal SP1 is found (Step SA5: Yes), determines whether this data is standard speckle data or measured speckle data (Step SA6). Control unit 41, when it determines that the data is standard speckle data (Step SA6: YES), determines that the sheet Pa in transport path 18 is an unused sheet (a sheet on which no fixing process has been performed), and compensates for lengthening that will be caused by fixing, and further corrects the image corrected in Step SA1 (Step SA7).

Next, control unit 41 controls image forming stations 2Y, 2M, 2C and 2K according to the image corrected. Under the control of control unit 41, the respective colors of exposure units 7Y, 7M, 7C and 7K are scanned with laser beam, and an electrostatic latent image is formed on the surfaces of photoreceptor drums 6Y, 6M, 6C and 6K. The latent image of the images of the respective colors formed on photoreceptor drums 6Y, 6M, 6C, and 6K are developed on photoreceptor drums 6Y, 6M, 6C and 6K using the respective toner colors. Then, the respective color images developed are transferred onto the outer circumferential surface of transfer belt 10 by transferring units 14Y, 14M, 14C and 14K (Step SA8).

Next, control unit 41 moves the image formed on transfer belt 10 in the direction of sheet transferring unit 15 by rotationally moving transfer belt 10. As well, control unit 41 rotates transport roller 18*a*, and transports the sheet Pa in transport path 18 toward sheet transferring unit 15. The transported sheet Pa passes between the outer circumferential surface of transfer belt 10 and transferring roller 15*b*. In this manner, the image formed on the transfer belt 10 is transferred onto sheet Pa (Step SA9).

Next, control unit 41 moves conveying belt 19 rotationally and by passing it through sheet transferring unit 15, moves the sheet Pa with the image transferred toward fixing unit 20. Sheet Pa transported to fixing unit 20 passes through the "nip" region between heat-fusing roller 20*a* and pressing roller 20*b*. In this manner, the toner image added to sheet Pa by heat and pressure is fused and fixed on sheet Pa (Step SA10)

Next, control unit 41 controls speckle measuring unit 30B and projects a laser beam on the sheet Pa that has passed through fixing unit 20. This laser beam gives rise to speckles that diffuse from sheet Pa. Optical sensor 34 of speckle measuring unit 30B outputs a signal SP2 indicating these speckles to control unit 41 (Step SA11). A sheet Pa that has passed through fixing unit 20 will have been lengthened, in comparison to an unused sheet, by the heat and pressure. For this reason, when measuring the speckles using speckle measuring unit 30B, as long as the sheets are of the same type, the speckles measured will differ from the speckles as they were before sheet Pa Was used.

Control unit 41 generates measured speckle data representing by the signal SP2, and stores in storage part 105 the generated measured speckle data (Step SA12). When control unit 41 finishes measuring speckles using speckle measuring unit 30B, it rotates transport roller 21*a* and ejects sheet Pa to the exterior of image forming apparatus 1 (Step SA13).

In this manner, image forming apparatus 1, when it records the image on unused sheet Pa, measures the speckles of sheet Pa after the fixing operation, and stores measured speckle data representing the speckles measured.

[B-2. Example Operations in the Case of Using the Reverse Side of Paper]

Next, description will be given of the operations performed in the case where the sheet Pa on which images have been formed using the above example operations are stored in paper cassette 16*a*, and images are formed on the reverse side of the paper. It is to be noted that, because the operations up to the point of ejecting sheet Pa into transport path 18 from reading the document are the same as described above for image forming apparatus 1, description of those operations is omitted.

Control unit 41, when it ejects sheet Pa into transport path 18, controls speckle measuring unit 30C, and projects a laser beam onto sheet Pa from light source 35 (Step SA3). Because sheet Pa is the reverse side of a piece of paper, the dispersion of the laser beam will differ from how it is dispersed from an unused sheet Pa. In other words, speckles will arise that differ from the speckles that arise from an unused sheet Pa. It is to be noted that, because sheet Pa is a sheet on which an image is recorded by the example operations above, the speckles that arise in this situation will be the same as those speckles measured by speckle measuring unit 30B by the example actions above. The optical sensor outputs to control unit 41 a signal SP1 that represents these speckles.

Control unit 41, when it receives the signal SP1, reads out standard speckle data and measured speckle data recorded in storage part 105. Control unit 41 performs pattern matching on the speckles represented by signal SP1 and speckles represented by the speckle data read out, and searches for data representing speckles analogous to the speckles represented by signal SP1 (Step SA4). Control unit 41, in the case where data representing speckles analogous to the speckles represented by signal SP1 is found (Step SA 5: Yes), determines whether the data is standard speckle data or measured speckle data (Step SA6).

Here, the measured speckle data representing speckles of the sheet Pa, whose reverse side is being used, is already stored in storage part 105 by the operations above. For this reason, it is determined that the data representing speckles analogous to the speckles represented by signal SP1 is measured speckle data. Control unit 41, when it determines that the data is the measured speckle data (Step SA6: NO), determines that sheet Pa in transport path 18 is a reversed sheet (a sheet for which a fixing process has been performed in the past). Control unit 41, when it determines that sheet Pa in transport path 18 is a reversed sheet, does not perform corrections that compensate for lengthening from fixing processes on the image that has been corrected in Step SA1.

Control unit 41, according to the image corrected only by Step SA1, controls image forming stations 2Y, 2M, 2C and 2K. Under the control of control unit 41, the respective colors of exposure units 7Y, 7M, 7C and 7K are scanned with a laser beam, and an electrostatic latent image is formed on the surfaces of photoreceptor drums 6Y, 6M, 6C and 6K. The latent image of the images of the respective colors formed on photoreceptor drums 6Y, 6M, 6C, and 6K are developed on photoreceptor drums 6Y, 6M, 6C and 6K using the respective colors of toner. Then, the respective color images developed are transferred onto the outer circumferential surface of transfer belt 10 by transferring units 14Y, 14M, 14C and 14K (Step SA14).

Next, control unit 41 moves the image formed on the transfer belt 10 in the direction of the sheet transferring unit 15 by rotational movement of the transfer belt 10. As well, control unit 41 rotates transport roller 18*a*, and transports the sheet Pa in transport path 18 toward sheet transferring unit 15. This transported sheet Pa passes between the outer circumferential surface of transfer belt 10 and transferring roller 15*b*. In this manner, the image formed on the transfer belt is transferred onto sheet Pa (Step SA15).

Next, control unit 41 moves conveying belt 19 rotationally and by passing it through sheet transferring unit 15, moves the sheet Pa with the image transferred toward fixing unit 20. Sheet Pa transported to fixing unit 20 passes through the "nip" region between heat-fusing roller 20*a* and pressing roller 20*b*. In this manner, the toner image added to sheet Pa by heat and pressure is fixed and fused on sheet Pa (Step SA16). Control unit 41, when sheet Pa passes through fixing unit 20, rotates transport roller 21*a* and ejects sheet Pa to the exterior of image forming apparatus 1 (Step SA13).

In this manner, image forming apparatus 1, by measuring speckles, becomes able to decide whether or not sheet Pa is a reversed sheet. In this manner, image forming apparatus 1, when recording an image on a reverse side, because it does not perform corrections that compensate for lengthening of the sheet by fixing, can record on sheet Pa a highly accurate image.

[B-3. Example Operations in the Case of Forming Images on Both Sides of Sheet Pa]

Next, the operations in the case of forming images on both sides of an unused sheet Pa will be explained. It is to be noted that, because the operations up to the point of ejecting sheet Pa into transport path 18 from reading the document (Steps SB1, Step SB2) are the same as described above for image forming apparatus 1, description of those operations is omitted.

Figure 6:
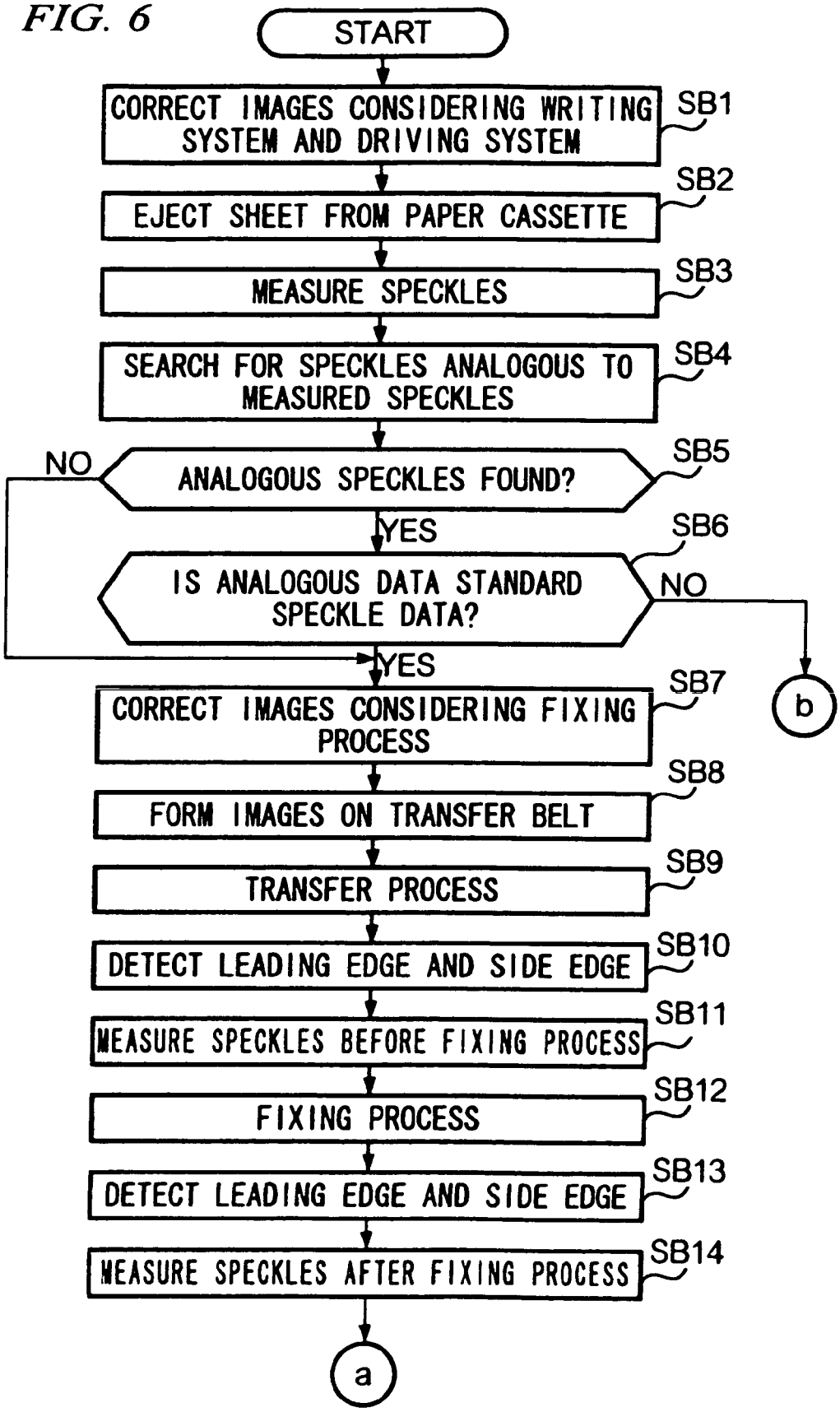
FIG. 6 is a flowchart showing the flow of operations when images are formed on both sides of a sheet.

Control unit 41 controls speckle measuring unit 30C, and projects a laser beam onto sheet Pa in transport path 18 (FIG. 6: Step SB3). This laser beam gives rise to speckles that diffuse from sheet Pa. The optical sensor 36 of speckle measuring unit 30C outputs to control unit 41 a signal SP1 that indicates these speckles.

Control unit 41, when it receives the signal SP1, reads out standard speckle data and measured speckle data recorded in storage part 105. Control unit 41 performs pattern matching on the speckles indicated by signal SP1 and speckles represented by the speckle data read out, and searches for data representing speckles analogous to the speckles represented by signal SP1 (Step SB4). Control unit 41, in the case where data representing speckles analogous to the speckles represented by signal SP1 is found (Step SB 5: Yes), determines whether the data is standard speckle data or measured speckle data (Step SB6). Here, control unit 41, when it determines that the data is measured speckle data (Step SB6: NO), determines that sheet Pa in transport path 18 is a reversed sheet (a sheet on which a fixing process has been performed in the past).

Control unit 41, in the case where it determines that sheet Pa in transport path 18 is a reverse side, because an image is already formed on one side of sheet Pa, determines that it cannot perform image formation on both sides, and ejects sheet Pa to sheet transferring unit 15 by rotating transport roller 18*a*. Control unit 41, for sheet transferring unit 15, passes on sheet Pa without having image transferring performed on it, and next transports sheet Pa to fixing unit 20 by rotationally moving conveying belt 19. Control unit 41, for fixing unit 20, passes on sheet Pa without having a fixing operation performed on it, and next rotates transport roller 21*a* and ejects sheet Pa that has been determined to be a reverse side to the exterior of image forming apparatus 1 (Step SB21).

On the other hand, control unit 41, in the case where it determines that sheet Pa in transport path 18 is an unused sheet and not a reverse side, compensates for the lengthening by fixing, and corrects the image that has been corrected by Step SB1 (Step SB7).

Next, control unit 41 controls image forming stations 2Y, 2M, 2C and 2K according to the image corrected. Under the control of control unit 41, a laser beam is scanned over the respective color exposure units 7Y, 7M, 7C and 7K, and an electrostatic latent image is formed on the surfaces of photoreceptor drums 6Y, 6M, 6C and 6K. The latent image for the respective color images formed on photoreceptor drums 6Y, 6M, 6C, and 6K is developed on photoreceptor drums 6Y, 6M, 6C, and 6K by using respective colors of toner. Then, the respective color images developed are transferred onto the outer circumferential surface of transfer belt 10 by transferring units 14Y, 14M, 14C and 14K (Step SB8).

Next, control unit 41, by rotationally moving the transfer belt, moves the images formed on the transfer belt in the direction of sheet transferring unit 15. As well, control unit 41 rotates transport roller 18*a* and transports sheet Pa in transport path 18 to the sheet transferring unit 15. This transported sheet Pa is passed between the outer circumferential surface of the transfer belt 10 and transferring roller 15*b*. In this way, the image formed on the transfer belt is transferred on sheet Pa (Step SB9).

Next, control unit 41 rotationally moves conveying belt 19, and transports sheet Pa on which the image has been transferred to the location of speckle measuring unit 30A. When sheet Pa is transported up to speckle measuring unit 30A, control unit 41 controls speckle measuring unit 30A and, using a light source and an optical sensor for detecting the location of the edge of sheet Pa, first, detects the location of the edge downstream of sheet Pa along the transport path (hereafter, this edge is the "leading edge"), and the location of the side edge of sheet Pa (the edge on the right side when viewed from downstream of the transport path; hereafter, this edge is the "side edge") (Step SB10).

Figure 8:
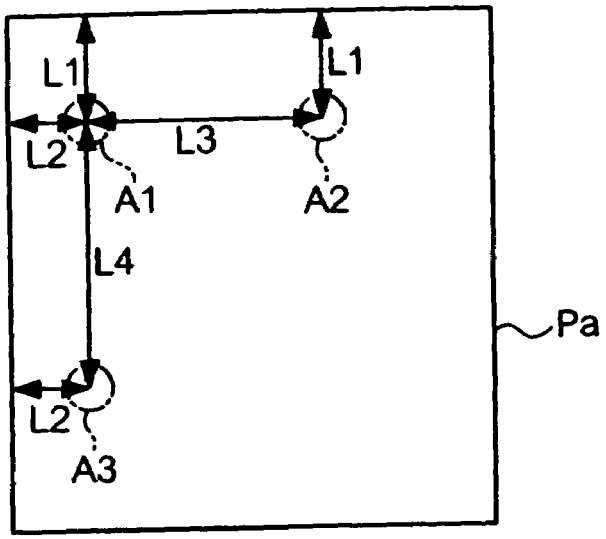
FIG. 8 shows a speckle detection location.

Next, control unit 41 rotationally moves conveying belt 19 and moves sheet Pa in the direction of the fixing unit 20. Next, control unit 41 measures the speckles of sheet Pa prior to fixing (Step SB11). More specifically, control unit 41 controls light source 31*a* and, as shown in FIGS. 2 and 8, projects a laser beam at location A1 separated by only a prescribed distance L1 from the leading edge and by a prescribed distance L2 from the side edge. As well, control unit 41 controls light source 31*b*, and, as shown in FIGS. 2 and 8, projects laser beam toward a location A2 separated by a prescribed distance L1 from the leading edge and separated by a prescribed distance L3 toward the main scanning direction from location A1. When the laser beam is projected onto location A1 of sheet Pa, the laser beam diffuses at location A1 and speckles arise. Optical sensor 32*a* outputs to control unit 41 a signal SP11 representing these speckles. As well, when the laser beam is projected onto location A2 of sheet Pa, the laser beam disperses at location A2 and speckles arise. Optical sensor 32*b* outputs to control unit 41 a signal SP12 representing these speckles. Control unit 41 stores in RAM speckle data 11 representing the speckles of this signal SP11 and speckle data 12 representing the speckles of speckle signal SP12.

Figure 9:
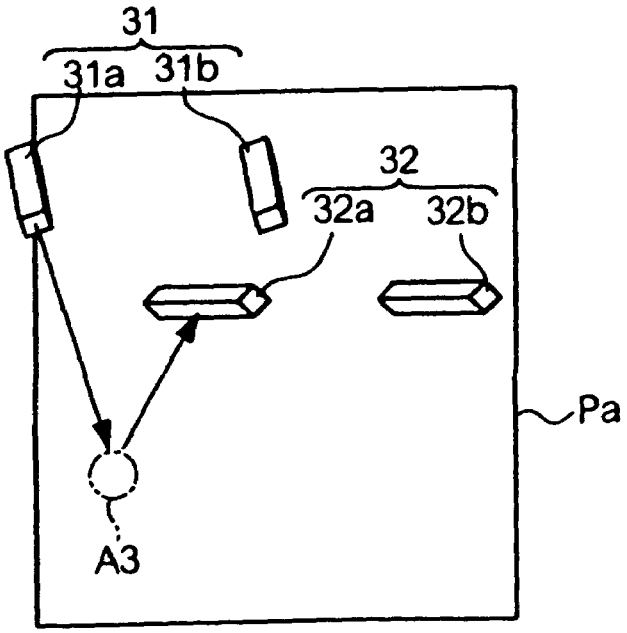
FIG. 9 shows a speckle detection location.

Next, control unit 41 rotationally moves conveying belt 19, and assuming location A1 as reference, moves sheet Pa in the sub scanning direction by only the prescribed distance L4 as shown in FIG. 8. Afterward, control unit 41 controls light source 31*a*, and, as shown in FIG. 9, projects a laser beam toward location A3 separated by only a prescribed distance L2 from the side edge, and by a prescribed distance L4 from location A1. When the laser beam is projected onto location A3 of sheet Pa, the laser beam diffuses at location A3 and speckles arise. Optical sensor 32*a* outputs to control unit 41 a signal SP13 representing these speckles. Control unit 41 stores in RAM speckle data 13 representing the speckles of this signal SP13.

When control unit 41 completes the measurement of speckles prior to fixing, it rotationally moves conveying belt 19 and moves sheet Pa further in the direction of fixing unit 20. When sheet Pa transported to fixing unit 20 passes through the "nip" region between heat-fusing roller 20*a* and pressing roller 20*b*, a toner image is fused and fixed onto sheet Pa to which heat and pressure have been added (Step SB12). Afterward, sheet Pa is moved to the location of speckle measuring unit 30B. When sheet Pa is moved to the location of speckle measuring unit 30B, control unit 41 controls speckle measuring unit 30B, and using a light source and an optical sensor for detecting the location of the edge of sheet Pa, first, detects the location of the leading edge and the side edge of sheet Pa (Step SB13).

Next, control unit 41 measures the speckles of sheet Pa after fixing (Step SB14). More specifically, control unit 41 detects the locations of the leading edge and the side edge, and controls light source 33*a*, and projects a laser beam on sheet Pa while scanning toward the major scanning direction, and controls light source 33*b*, and projects a laser beam on sheet Pa while scanning toward the major scanning direction. Then, control unit 41, while maintaining the projection of laser beams with light sources 33*a* and 33*b*, moves sheet Pa in the sub scanning direction by rotating transport roller 21*a*. In this way, while the projection of the laser beams from light sources 33*a* and 33*b* is maintained, optical sensor 34*a* receives light diffused by sheet Pa, and outputs to control unit 41 a signal SP21 representing speckles, and optical sensor 34*b* receives light diffused by sheet Pa, and outputs to control unit 41 a signal SP21 representing speckles.

Figure 10:
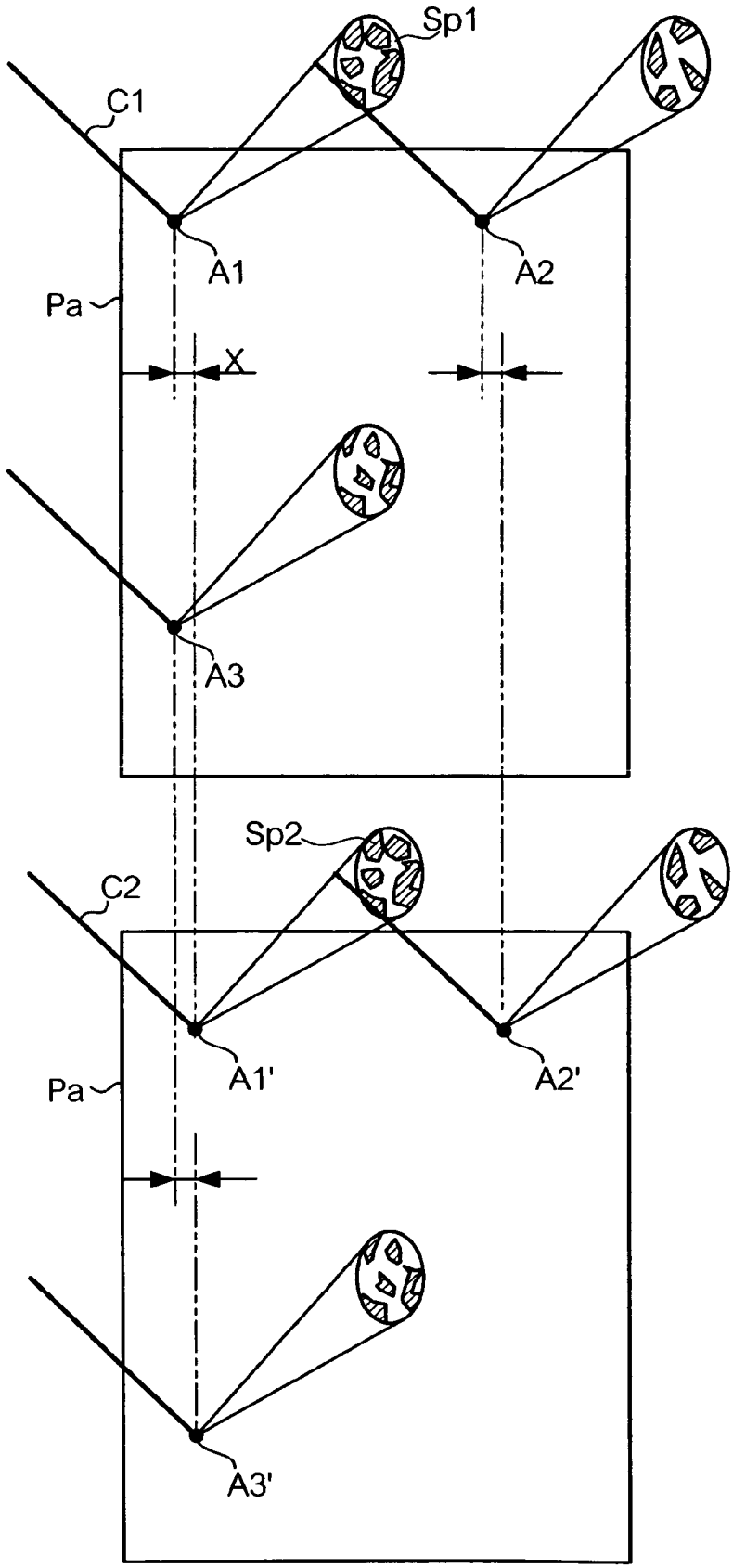
FIG. 10 illustrates changes in the location in the major scanning direction by lengthening of a sheet.
Figure 11:
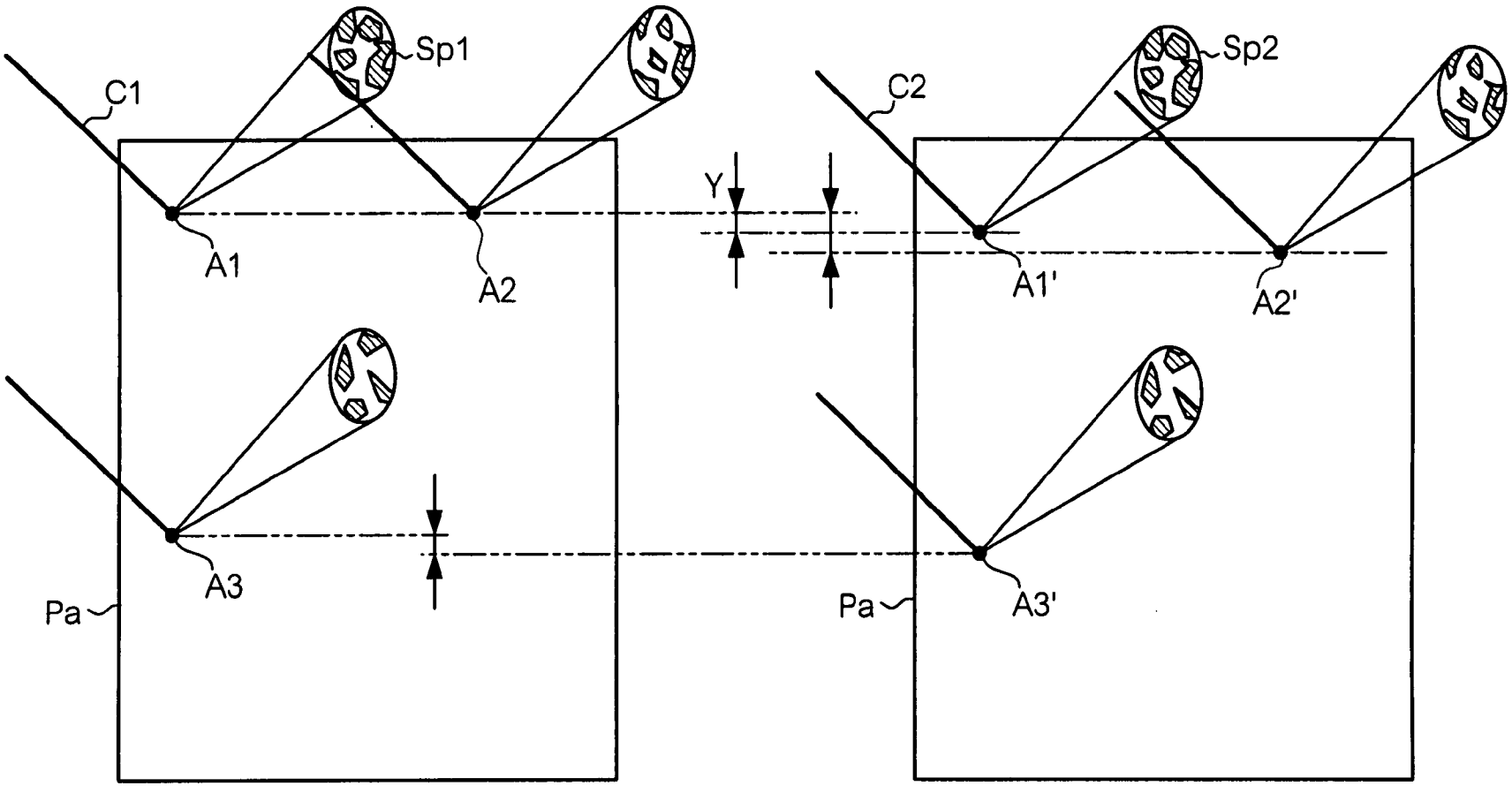
FIG. 11 illustrates changes in the location in the sub scanning direction by lengthening of a sheet.

When control unit 41 receives the signal SP21 continuously output from optical sensor 34*a*, it seeks the concordance rate with the speckles represented by the signal SP21 and the speckles represented by speckle data 11 and 13, and in the case where the concordance rate is equal to or above a prescribed value, records location A1' on which the laser beam is projected by light source 33*a*. As shown in FIGS. 10 and 11, prior to the fixing process, laser beam C1 projected onto location A1 by light source 31*a* diffuses from location A1 and in this way gives rise to speckles Sp1. However, in the case of lengthening in the major scanning direction X and the sub scanning direction Y by the fixing process, speckles Sp2 indicating a predetermined concordance rate with speckles Sp1 are measured at a location separated from A1 by "X in the main scanning direction and Y in the sub scanning direction". Control unit 41 records location A1' separated from A1 "by X in the main scanning direction, and by Y in the sub scanning direction".

Figure 12:
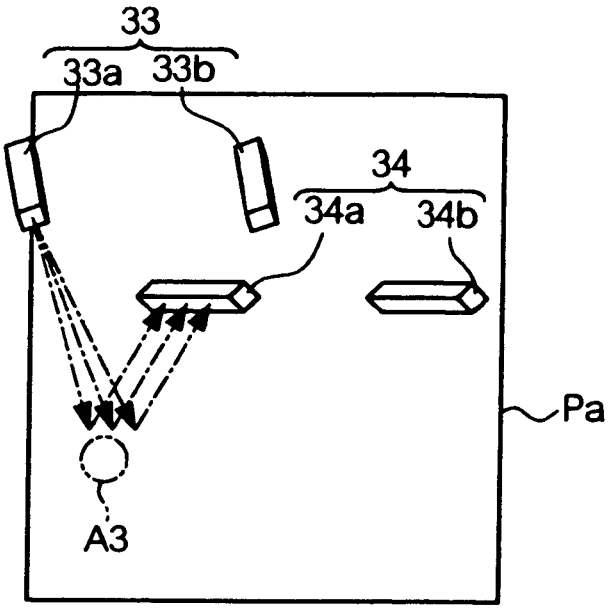
FIG. 12 shows a speckle detection location.

Similarly, when control unit 41 receives the signal SP22 continuously output from optical sensor 34*b*, it seeks the concordance rate with the speckles represented by the signal SP22 and the speckles represented by speckle data 12, and in the case where the concordance rate is equal to or above a prescribed value, records location A2' onto which the laser beam is projected by light source 33*b*. As well, control unit 41 transports the sheet as shown in FIG. 12, and in the case where the concordance rate between speckles indicated by signal SP21 and speckles represented by speckle data 13 is equal to or above a prescribed value, records location A3' onto which the laser beam is projected by light source 33*a*.

Figure 7:
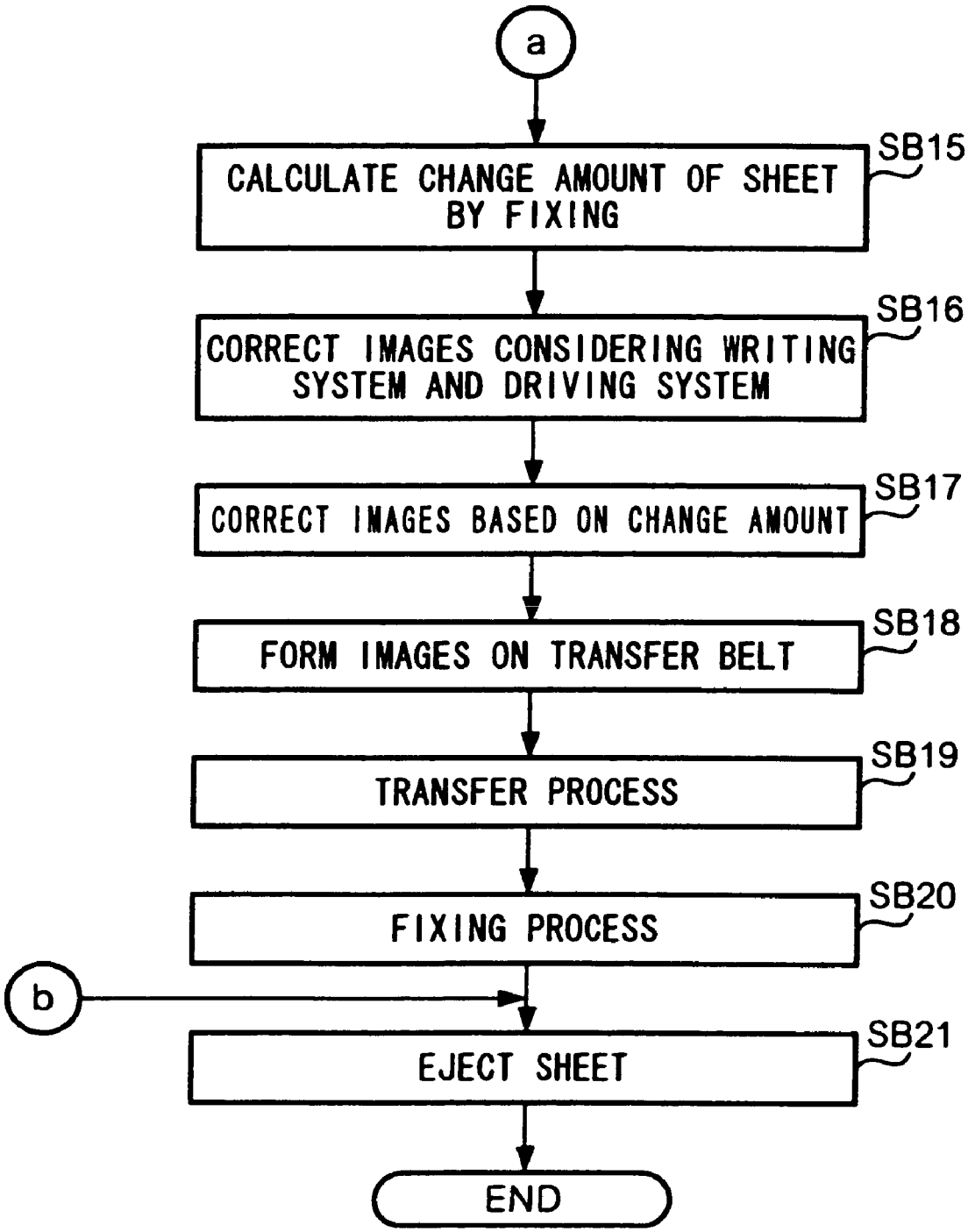
FIG. 7 is a flowchart showing the flow of operations when images are formed on both sides of a sheet.

Next, control unit 41, using locations A1, A2 and A3, and locations A1', A2', and A3', seeks change amount of all variations of sheet Pa produced by fixing operations (FIG. 7: Step SB15). Control unit 41 seeks the differences between the coordinate values of the major scanning directions for locations A1' and A1. Then, it assumes the found difference as the major scanning direction location change amount D10 for location A1. As well, control unit 41 seeks the difference between the coordinate values for the sub scanning directions of locations A1' and A1. Then, it assumes the found difference as the sub scanning direction location change amount D11 for location A1.

As well, control unit 41 seeks the difference d21 between the coordinate values for the major scanning directions of locations A2 and A1. As well, control unit 41 seeks the difference d22 between the coordinate values for the major scanning directions of locations A2' and A1'. Then, control unit 41 seeks the difference between difference d22 and d21, and assumes the found difference as the distance change amount D20 between locations A1 and A2.

As well, control unit 41 seeks the difference d31 between the coordinate values for the sub scanning directions of locations A3 and A1. As well, control unit 41 seeks the difference d32 between the coordinate values for the sub scanning directions of locations A3' and A1'. Then, control unit 41 seeks the difference between difference d32 and d31, and assumes the found difference as the distance change amount D30 between locations A1 and A3.

When control unit 41 completes the calculation of the various types of change amount, it rotates transport rollers 22*a* and 23*a*, and transports sheet Pa toward transport path 18. By this transport, the surface of sheet Pa that is a reverse side of a surface on which the image is recorded comes into contact with transfer belt 10. Next, control unit 41, similarly to Step SB1, corrects the image represented by the document data (Step SB16). Next, control unit 41, based on the change amount of all variations found in Step SB15, corrects the image represented by the image data (Step SB17). More specifically, it corrects the write-start locations of the image using location change amounts D11 and D11. As well, it corrects the size of the image in the major scanning direction using change amount D20 (major scanning direction magnification) and corrects the size of the image in the sub scanning direction using change amount D30 (sub scanning direction magnification).

When control unit 41 completes the image correction above, it controls image forming stations 2Y, 2M, 2C and 2K according to the image corrected. Under the control of control unit 41, a laser beam is scanned over the respective color exposure units 7Y, 7M, 7C and 7K, and an electrostatic latent image is formed on the surfaces of photoreceptor drums 6Y, 6M, 6C and 6K. The latent image for the respective color images formed on photoreceptor drums 6Y, 6M, 6C, and 6K is developed on photoreceptor drums 6Y, 6M, 6C, and 6K by using respective colors of toner. Then, the respective color images developed are transferred onto the outer circumferential surface of transfer belt 10 by transferring units 14Y, 14M, 14C and 14K (Step SB18).

Next, control unit 41, by rotationally moving the transfer belt, moves the images formed on the transfer belt in the direction of sheet transferring unit 15. As well, control unit 41 rotates transport roller 18*a* and transports sheet Pa in transport path 18 to the sheet transferring unit 15. This transported sheet Pa is passed between the outer circumferential surface of the transfer belt 10 and transferring roller 15*b*. In this way, the image formed on the transfer belt is transferred on sheet Pa (Step SB19).

Next, control unit 41 moves conveying belt 19 rotationally, and by passing it through sheet transferring unit 15, moves the sheet Pa with the image transferred toward fixing unit 20. Sheet Pa transported to fixing unit 20 passes through the "nip" region between heat-fusing roller 20*a* and pressing roller 20*b*. In this manner, the toner image added to sheet Pa by heat and pressure is fused and fixed on sheet Pa (Step SB20). Control unit 41, when sheet Pa passes through fixing unit 20, rotates transport roller 21*a* and ejects sheet Pa to the exterior of image forming apparatus 1 (Step SB21).

As explained above, in the case of an image being recorded on both sides of sheet Pa, because recording of the image is performed by compensating for the change amounts in sheet Pa by fixing, it is possible to record on sheet Pa an image of high accuracy. As well, with the embodiment above, in the case where reverse sides are stored in a paper cassette when forming images on both sides of sheets Pa, it is possible to eject a reverse side without recording an image.

[C. Modifications]

Above, an embodiment of the present invention has been explained, but the above embodiment may take the forms described below.

In the case where a reverse side is detected when recording an image on both sides of sheet Pa, detection of the reverse side may be notified without ejecting the reverse side from image forming apparatus 1.

Figure 13:
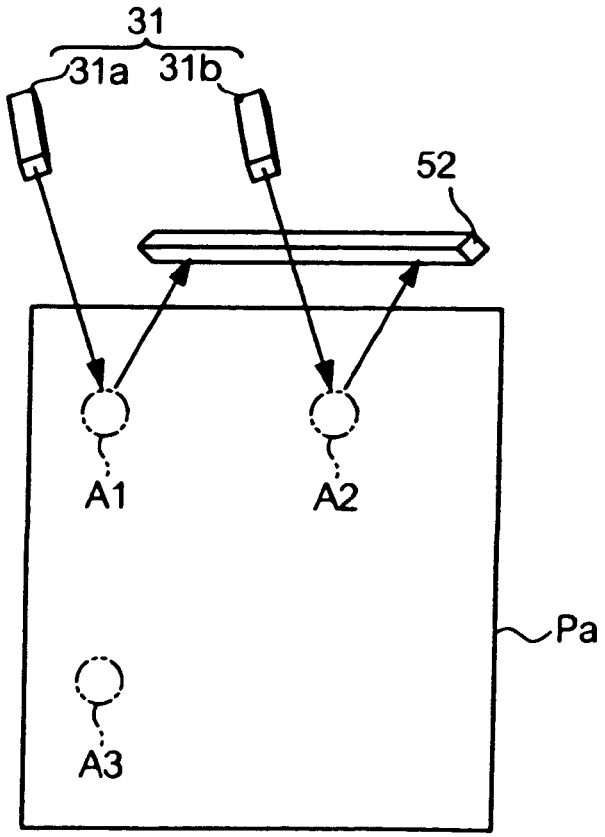
FIG. 13 shows a modification of the speckle measuring unit.
Figure 14:
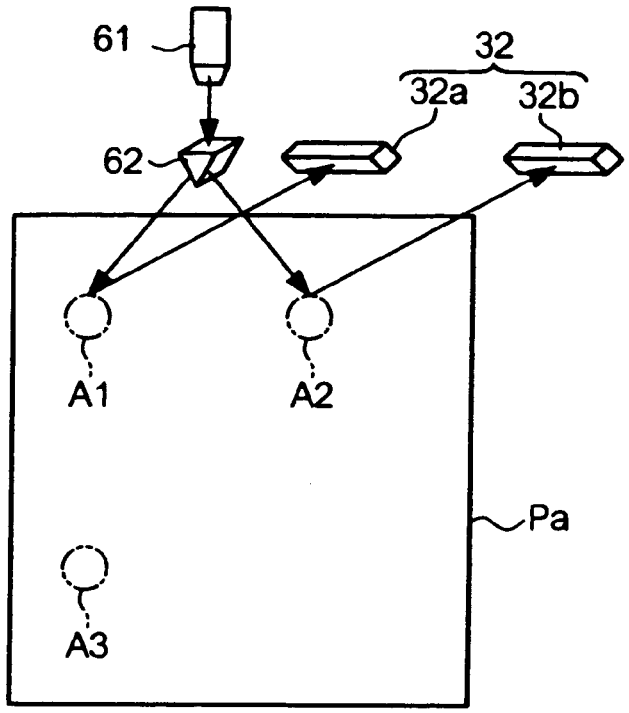
FIG. 14 shows a modification of the speckle measuring unit.
Figure 15:
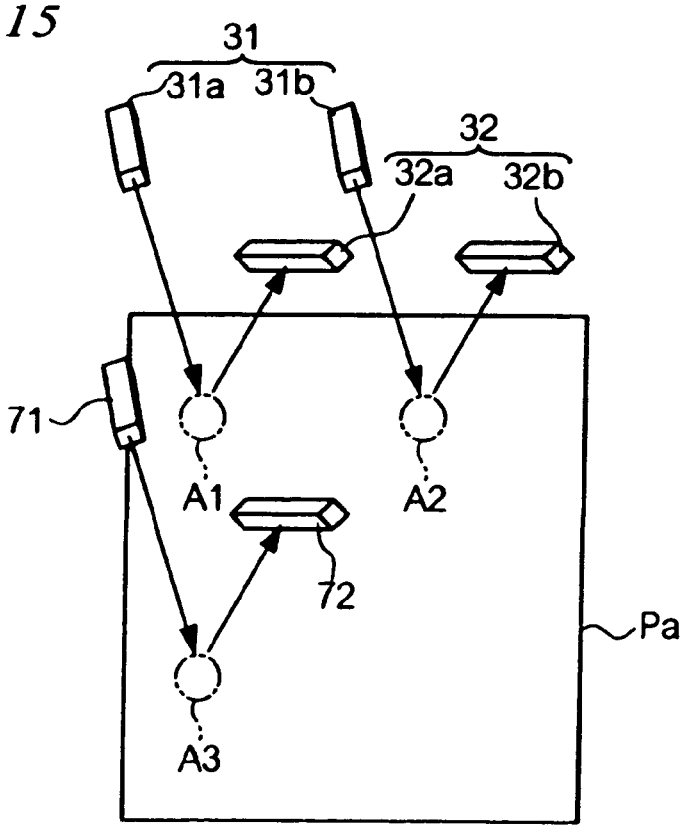
FIG. 15 shows a modification of the speckle measuring unit.

For the speckle measuring unit, as shown in FIG. 13, one optical sensor may be provided almost vertically in the transport direction of the sheet. As well, for the speckle measuring unit, as shown in FIG. 14, the laser beam output from one light source 61 may be partitioned by a beam-splitter 62, and may project the laser beam onto locations A1 and A2. As well, for the speckle measuring unit, as shown in FIG. 15, the light source and the optical sensor may be triply provided, and speckle measurements at locations A1, A2 and A3 may be performed simultaneously.

For the above embodiments, respective color images are formed on transfer belt 10, and the images are transferred onto sheet Pa, but a way of recording the images on sheet is not restricted to such a method. For example, the sheet Pa may be positioned on the transfer belt, the positioned sheet Pa transported to an image forming station, and the respective color images transferred on the sheet Pa at the respective color image forming station.

The above embodiments may incorporate multiple light sources and optical sensors upstream of sheet transferring unit 15 on the transport path and may detect attitude changes in sheet Pa by these light sources and optical sensors, and correct the image based on these attitude changes.

Memory part 105 may store long grain recording medium speckle data and short grain recording medium speckle data as standard speckle data, and may perform pattern matching with this standard speckle data and speckle patterns measured with speckle measuring unit 30C. Then, by determining whether speckle data determined to be analogous to standard speckle data is long grain speckle data, or short grain speckle data, it recognizes the paper grain, and in response to the paper grain recognized, performs corrections that compensate for recording medium lengthening from fixing processes on images corrected in Step SA1. With such an embodiment, it is possible to perform corrections of images with higher accuracy.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments, and with the various modifications as are suited to the particular use contemplated. It is intended that the scope of the invention be defined by the following claims and their equivalents.

The entire disclosure of Japanese Patent Application No. 2004-184885 filed on Jun. 23, 2004 including specification, claims, drawings and abstract is incorporated herein by reference in its entirety.

What is claimed is:

1. An image forming apparatus provided with an image forming part for forming document images on a recording medium, and a fixing part for fixing the images formed on the recording medium to the recording medium, wherein the apparatus comprising:

a first measuring part which is downstream of the fixing part in a transport path for the recording medium, measures speckles in the recording medium transported, and generates a measured speckle data representing the measured speckles;

a memory part for storing the measured speckle data generated by the first measuring part with a standard speckle data representing speckles on the recording medium that has not undergone the fixing part;

a second measuring part which is upstream of the image forming part in a transport path for the recording medium, and measures speckles on the recording medium transported; and a correction part which applies corrections to the document images formed on the recording medium in order to compensate for the lengthening of the recording medium formed by the fixing part in a case where among the speckle data stored in the memory part, the standard speckle data is the most analogous to the speckles measured by the second measuring part; and, does not apply corrections to the document images formed on the recording medium in order to compensate for the lengthening of the recording medium formed by the fixing part in a case where, among the speckle data, stored in the memory part, the measured speckle data is the most analogous to the speckles measured by the second measuring part.

2. An image forming apparatus provided with an image forming part for forming document images on a recording medium, and a fixing part for fixing the images formed on the recording medium to the recording medium, wherein the apparatus comprising:

a memory part for storing a long grain speckle data representing speckles of the recording medium on the direction of a long grain and a short grain speckle data representing speckles of the recording medium on the direction of a short grain;

a first measuring part which is upstream of the image forming part in a transport path for the recording medium, and measures speckles on the recording medium transported; and a correction part which applies corrections to the document images formed on the recording medium in order to compensate for the lengthening of the recording medium that is fixed on the direction of the long grain in a case where, among the speckle data stored in the memory part, the long grain speckle data is the most analogous to the speckles measured by the first measuring part; and applies corrections to the document images formed on the recording medium in order to compensate for the lengthening of the recording medium that is fixed on the direction of the short grain in a case where, among the speckle data stored in the memory part, the short grain speckle data is the most analogous to the speckles measured by the first measuring part.

* * * * *